US011336027B2

(12) United States Patent
Hyman et al.

(10) Patent No.: US 11,336,027 B2
(45) Date of Patent: May 17, 2022

(54) FILTERING PROXIMITY ANTENNA ARRAY

(71) Applicant: IXI Technology Holdings, Inc., Yorba Linda, CA (US)

(72) Inventors: Daniel Hyman, Long Beach, CA (US); Byron del Castillo, Eastvale, CA (US); William Herbert Darden, IV, Cary, NC (US)

(73) Assignee: IXI Technology Holdings, Inc., Yorba Linda, CA (US)

( * ) Notice: Subject to any disclaimer, the term of this patent is extended or adjusted under 35 U.S.C. 154(b) by 43 days.

(21) Appl. No.: 16/810,776

(22) Filed: Mar. 5, 2020

(65) Prior Publication Data

US 2021/0280983 A1 Sep. 9, 2021

(51) Int. Cl.

| | |
|---|---|
| ***H01Q 11/08*** | (2006.01) |
| ***H01Q 19/30*** | (2006.01) |
| ***H01Q 1/48*** | (2006.01) |
| ***H01Q 15/02*** | (2006.01) |
| ***H01Q 1/38*** | (2006.01) |
| ***H01Q 15/14*** | (2006.01) |

(52) U.S. Cl.

CPC ..... *H01Q 19/30* (2013.01); *H01Q 1/38* (2013.01); *H01Q 1/48* (2013.01); *H01Q 11/08* (2013.01); *H01Q 15/02* (2013.01); *H01Q 15/14* (2013.01)

(58) Field of Classification Search

CPC .. H01Q 19/30; H01Q 1/38–1/48; H01Q 11/08
See application file for complete search history.

(56) References Cited

U.S. PATENT DOCUMENTS

| | | | | |
|---|---|---|---|---|
| 2,611,868 | A | 9/1952 | Marston et al. | |
| 4,249,147 | A | 2/1981 | Kaegebein | |
| 7,158,819 | B1 | 1/2007 | Pulimi et al. | |
| 2009/0124215 | A1* | 5/2009 | Nysen | H01Q 21/28 455/90.1 |
| 2011/0063187 | A1* | 3/2011 | Huang | H01Q 19/10 343/893 |
| 2011/0254749 | A1 | 10/2011 | Amari et al. | |
| 2013/0069837 | A1* | 3/2013 | Cozzolino | H01Q 1/521 343/727 |
| 2015/0249485 | A1 | 9/2015 | Ouyang et al. | |

(Continued)

FOREIGN PATENT DOCUMENTS

| | | | |
|---|---|---|---|
| CN | 106207422 | A | 12/2016 |
| WO | 2019161104 | A1 | 8/2019 |

*Primary Examiner* — Hasan Islam
(74) *Attorney, Agent, or Firm* — The Watson IP Group, PLC; Jovan N. Jovanovic

(57) ABSTRACT

A system includes a first antenna and a second antenna. The first antenna includes an antenna section. The antenna section includes a first antenna segment, a second antenna segment adjacent to the first antenna segment, and a notch circuit disposed within a notch between the first antenna segment and the second antenna segment. The notch circuit prevents a first frequency of a signal from passing from the first antenna segment to the second antenna segment while allowing a second frequency from the signal to pass from the first antenna segment to the second antenna segment. The second antenna is disposed proximate to the first antenna. The first antenna occupies a second near field region of the second antenna and the second antenna occupies a first near field region of the first antenna.

10 Claims, 5 Drawing Sheets

(56) References Cited

U.S. PATENT DOCUMENTS

| | | | | |
|---|---|---|---|---|
| 2017/0063411 | A1 | 3/2017 | Ripley et al. | |
| 2018/0287244 | A1* | 10/2018 | Sharawi | H01Q 1/36 |
| 2019/0115654 | A1 | 4/2019 | Huang et al. | |

* cited by examiner

FILTERING PROXIMITY ANTENNA ARRAY

CROSS-REFERENCE TO RELATED APPLICATION

NA

BACKGROUND OF THE DISCLOSURE

1. Field of the Disclosure

The disclosure relates in general to an antenna, and more particularly, to a proximity hybrid antenna array.

2. Background Art

Numerous systems, especially handheld and portable systems, utilize different types of antennas in close proximity to each other. Close proximity, as used herein, refers to at least two antennas being within their frequency-dependent near-field range (e.g., "coupled" to those skilled in the art of antenna design), up to and including physical contact which includes capacitive high-frequency contact (e.g., "tightly coupled" or "AC coupled"), and which can even include Ohmic contact (e.g., "DC coupled"). The close proximity of multiple antennas can lead to undesired interactions between them, which can result in de-tuning of a frequency of resonance and/or unacceptable operation of antennas, which result in formation of nulls within one or more antennas' operating bands, and/or redirection of the radiation pattern (e.g., "beam-steering") of one or more antennas.

SUMMARY OF THE DISCLOSURE

The disclosure is directed to a system that includes a first antenna and a second antenna. The first antenna includes an antenna section. The antenna section includes a first antenna segment, a second antenna segment adjacent to the first antenna segment, and a notch circuit disposed within a notch between the first antenna segment and the second antenna segment. The notch circuit prevents a first frequency of a signal from passing from the first antenna segment to the second antenna segment while allowing a second frequency from the signal to pass from the first antenna segment to the second antenna segment. The second antenna is disposed proximate to the first antenna. The first antenna occupies a second near field region of the second antenna and the second antenna occupies a first near field region of the first antenna.

In some configurations, the first antenna is a Quasi-Yagi Ultra High Frequency (UHF) antenna and the second antenna is a nested coaxial helical antenna.

In some configurations, the notch circuit includes a capacitor in parallel with an inductor.

In some configurations, the notch circuit is a first notch circuit and the antenna section includes a third antenna section disposed between the first antenna section and the second antenna section, the first notch circuit including a first capacitor disposed between the first antenna segment and the third antenna segment and the second notch circuit is disposed between the third antenna segment and the second antenna segment, the second notch circuit including a second capacitor in parallel with an inductor.

In some configurations, the antenna section is a first antenna section, the system further including a second antenna section coupled to the first antenna section, the first antenna section preventing a first frequency range from passing to the second antenna section and the second antenna section preventing a second frequency range, the first frequency range different than the second frequency range, from passing beyond the second antenna section.

In some configurations, the system further includes a reflector element that includes the antenna section.

In some configurations, the system further includes a radiator element that includes the antenna section.

In some configurations, the system further includes a director element that includes the antenna section.

In some configurations, the system further includes a reflector element, a radiator element, and a director element, each of the reflector element, the radiator element, and the director element including the antenna section.

In some configurations, the system further includes a Printed Circuit Board (PCB), the first antenna being printed onto the PCB.

In some configurations, the system further includes a ground plane that electrically couples together the first and second antennas.

In some configurations, the second antenna includes a primary outer helix and an inner helix, the ground plane also coupling the primary outer helix and the inner helix together.

BRIEF DESCRIPTION OF THE DRAWINGS

The disclosure will now be described with reference to the drawings wherein.

DETAILED DESCRIPTION OF THE DISCLOSURE

Figure 1B:
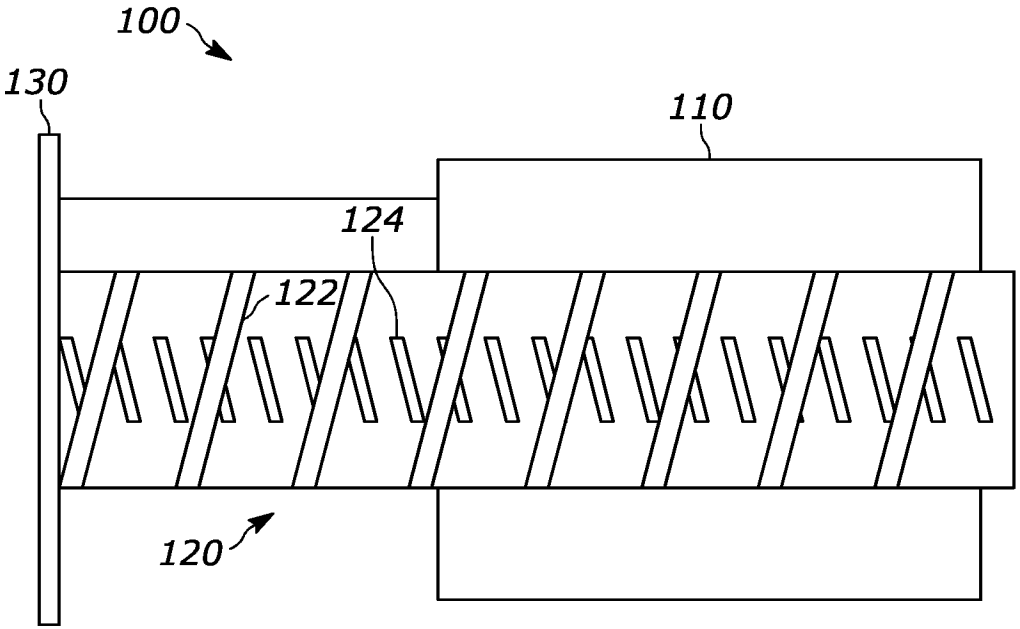
FIG. 1B illustrates a side view of the example antenna system shown in FIG. 1, in accordance with at least one embodiment disclosed herein.

While this disclosure is susceptible of embodiment(s) in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

In accordance with the embodiment(s) disclosed herein, one or more of a lower frequency first antenna's element(s) is segmented into small sections separated by band-stop circuitry, referred to herein as a notch circuit(s). The notch circuit(s) performs filtering in that the notch circuit(s) prevents signals of a higher frequency second antenna from achieving a resonant condition on original elements of a first antenna, which then renders the first antenna unable to support the transmission, reflection, or radiation of the higher frequency band-stop bands. Because the segments are typically too short in length to adversely affect specific frequencies of interest, they have a reduced impact on antenna performance.

As discussed in more detail below, the first antenna gets segmented, and in at least one embodiment, shortening in length and other physical and/or electrical characteristics to compensate for the addition of the notch circuit(s). The effect on the segmented antenna is typically a size reduction that ensures an aperture size-related reduction in gain, as well as a decrease in efficiency due to the higher losses in band-stop components compared to a typical radiating structure. The reduced efficiency results in a further reduction in realized gain of the segmented antenna beyond that associated with the reduction in aperture size.

High impedance resonant circuitry, or notch circuitry, are used with one or more element(s) of the first antenna, such as a lower-frequency antenna structure. These resonant circuit(s) serve as band stops for the frequency bands used by a second antenna, such as a higher frequency antenna, in close proximity to the first antenna. The band stops are sufficiently close together that the lengths of continuous low-impedance paths are significantly shorter than a half wavelength of the frequencies used by the second antenna. These aspects are arranged to result in a reduction in interference of the second antenna by the proximity of the first antenna.

Figure 1A:
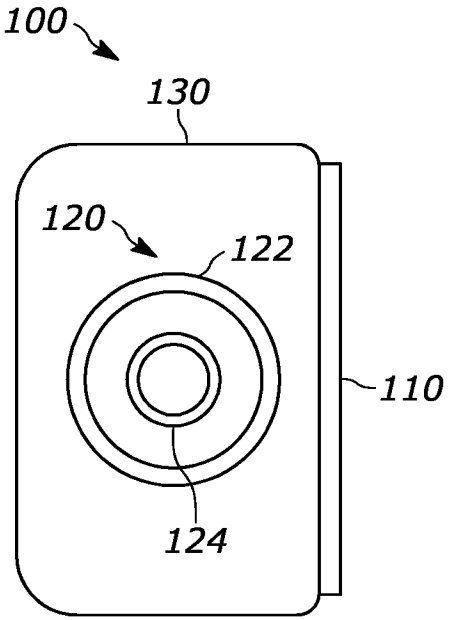
FIG. 1A illustrates a front view of an example antenna system, in accordance with at least one embodiment disclosed herein.

Referring now to the drawings and in particular to FIGS. 1A and 1B, at least one embodiment is disclosed, such as an antenna system 100 that includes a first antenna 110, such as a Quasi-Yagi Ultra High Frequency (UHF) antenna, and a second antenna 120, such as a nested coaxial helical antenna, together forming an antenna array. In at least one other embodiment, the first and second antennas 110/120 are other types of antennas, as understood by those skilled in the art. FIG. 1A illustrates a front view of the system 100 and FIG. 1B illustrates a side view of the system 100. In at least one embodiment, the first antenna 110 can operate between 856 and 1300 MHz. The first antenna 110 can operate in close proximity (e.g., close enough that operation of the second antenna 120 interferes with operation of the first antenna 110) to the second antenna 120, as shown in FIG. 1A. In at least one embodiment, the second antenna 120 can operate between 2400 and 2500 MHz as well as between 5700 and 5900 MHz. Each of the first and second antennas 110/120 occupies the other's near field region, which results in strong coupling between the first and second antennas 110/120 that can be measured. Such strong coupling can result in both operating frequency and antenna pattern for the first and second antennas 110/120 that suffer.

In at least one embodiment, the second antenna 120 includes a primary outer helix 122 and an inner helix 124. The outer helix 122 has a circular polarization and can operating between 2400 and 2500 MHz. The inner helix 124 has an opposing circular polarization and can operate between 5700 and 5900 MHz. A ground plane 130 electrically couples the first and second antennas 110/120 together and couples the outer and inner helixes 122/124 together. In at least one embodiment, a diameter of the outer helix 122 is approximately (+=10%) 3.9 cm, with spacing between each coil thereof approximately (+=10%) 3.1 cm. In at least one embodiment, a diameter of the inner helix 124 is approximately (+=10%) 1.6 cm, with spacing between each coil thereof approximately (+=10%) 1.3 cm.

Figure 2B:
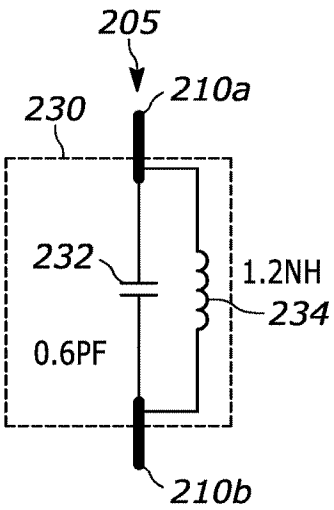
FIG. 2B illustrates the example antenna section of FIG. 2A including an example capacitor and inductor, in accordance with at least one embodiment disclosed herein.
Figure 2A:
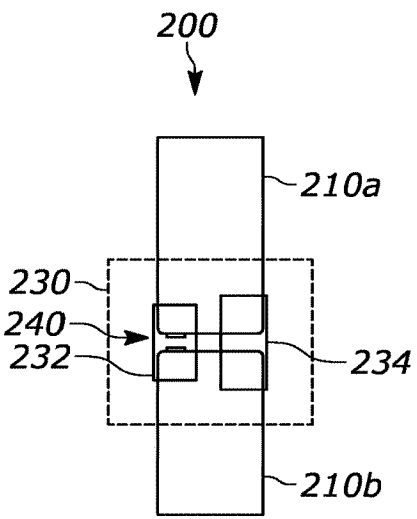
FIG. 2A illustrates an example antenna section for use with a first antenna of the antenna system, in accordance with at least one embodiment disclosed herein.

With reference to FIG. 2A, the first antenna 110 shown in FIGS. 1A and 1B can include an antenna section 200. The antenna section 200 includes a first antenna segment 210*a* and a second antenna segment 210*b*, with a single notch circuit 230 disposed within a notch 240 between the first and second antenna segments 210*a*/210*b*. The single notch circuit 230 performs filtering in that the notch circuit 230 prevents at least one first frequency of a signal from passing from the first antenna segment 210*a* to the adjacent second antenna segment 210*b*. The single notch circuit 230 allows at least one other second frequency from this same signal not in a band pass of the single notch circuit 230 to pass through the single notch circuit 230 comparatively unhindered. In at least one embodiment, the single notch circuit 230 includes a capacitor 232 in parallel with an inductor 234.

The single notch circuit 230 is a resonant circuit that has at least one narrowband predominantly reactive (as opposed to resistive) element, having very low series equivalent resistance and a high-quality factor Q. In at least one embodiment as shown in FIG. 2B, the capacitor 232 is a 0.6 pF capacitor in parallel and the inductor 234 is a 1.2 nH inductor. In at least one embodiment, the bandwidth of the single notch circuit 230 is between approximately (+=10%) 2.4 to 2.5 GHz, effectively preventing signals in this frequency range from passing through from the first antenna segment 210*a* to the second antenna segment 210*b*.

Figure 3B:
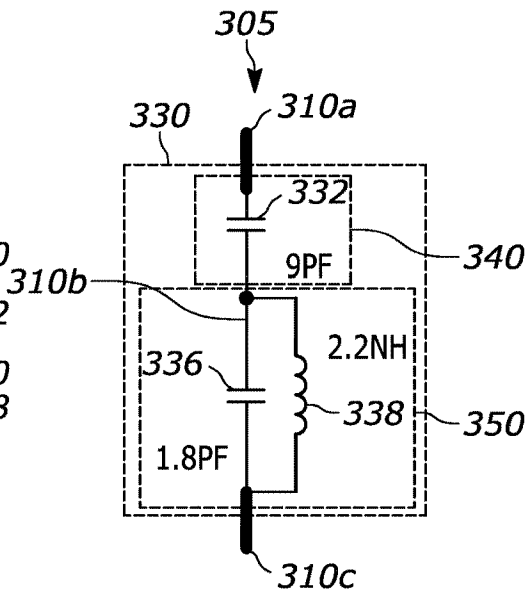
FIG. 3B illustrates the example antenna section of FIG. 3A including example capacitors and inductor, in accordance with at least one embodiment disclosed herein.
Figure 3A:
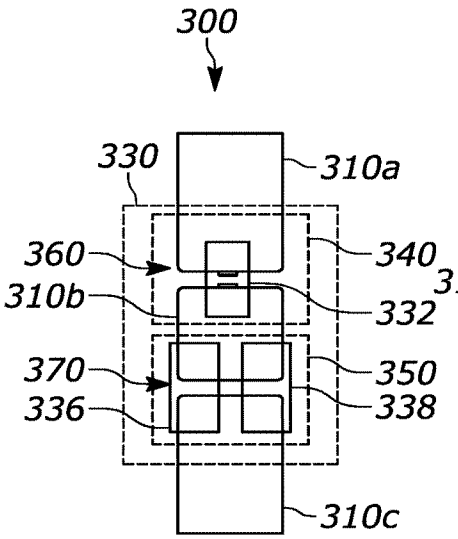
FIG. 3A illustrates another example antenna section for use with a first antenna of the antenna system, in accordance with at least one embodiment disclosed herein.

With reference to FIG. 3A, the first antenna 110 shown in FIGS. 1A and 1B can include an antenna section 300. The antenna section 300 includes a first antenna section 310*a*, a second antenna section 310*c*, and a third antenna section 310*b*, with another notch circuit, such as a dual notch circuit 330 disposed between the first antenna section 310*a* and the second antenna section 310*c*. The dual notch circuit 330 includes two narrowband predominantly reactive notches, such as a first notch circuit 340 disposed between the first antenna section 310*a* and the third antenna section 310*b* and a second notch circuit 350 disposed between the second antenna section 310*c* and the third antenna section 310*b*. In at least one embodiment, the first notch circuit 340 includes a first capacitor 332 that is disposed in a first notch 360, between the first antenna section 310*a* and the third antenna section 310*b*. The second notch circuit 350 includes a second capacitor 336 in parallel with an inductor 338 that are disposed in a second notch 370, between the third antenna section 310*b* and the second antenna section 310*c*.

The dual notch circuit 330 is a resonant circuit having very low series equivalent resistance and a high-quality factor Q. In at least one embodiment as shown in FIG. 3B, an antenna section 305 can include the first capacitor 332 that is 9 pF, the second capacitor that is 1.8 pF, and the inductor 338 that is 2.2 nH. In at least one embodiment, the bandwidth of a first notch circuitry 340 including the first capacitor 332 is at approximately (+−10%) 2.4 to 2.5 GHz and a bandwidth of a second notch circuit 350 including the second capacitor 336 in parallel with the inductor 338 is approximately (+−10%) 5.7 to 5.9 GHz, thus performing filtering in that the first and second notch circuits 340/350 effectively prevent these two frequency ranges from passing through from the first antenna section 310*a* to the otherwise adjacent second antenna section 310*c*. As with the single notch circuit 230 of FIG. 2A, signals that contain RF frequencies that are not in the notch bands pass through the first and second notch circuits 340/350 comparatively unhindered.

Figure 4:
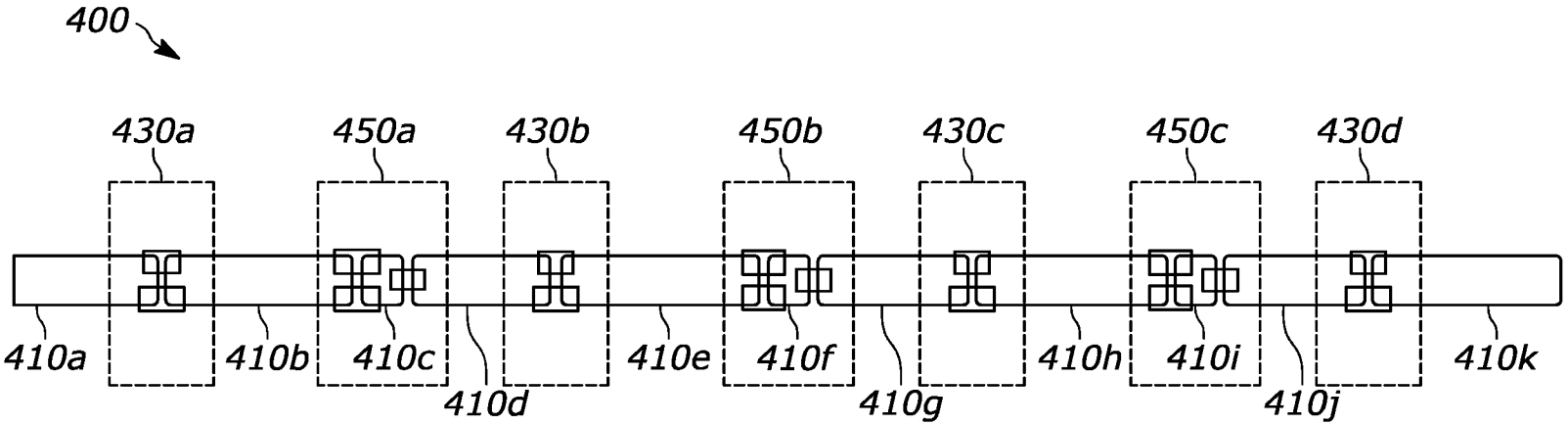
FIG. 4 illustrates an example plurality of notch circuits that form an example director element, in accordance with at least one embodiment disclosed herein.

FIG. 4 illustrates a plurality of notch circuits, such as the notch circuits 230/330, arranged to form an example director element 400. The length for the director element 400 is shown as divided into short piecewise linear antenna segments 410*a*/410*b*/410*d*/410*e*/410*g*/410*h*/410*j*/410*k*, plus three very short antenna segments 410*c*/410*f*/410*i*, equal to the length of a pair of surface mount component bond pads.

In at least one embodiment, the antenna segments 410*a*/410*b*/410*d*/410*e*/410*g*/410*h*/410*j*/410*k* can range between approximately (+−10%) 0.290 and approximately (+−10%) 0.370 inches and the segments 410*c*/410*f*/410*i* can be approximately (+−10%) 0.080 inches. The director element 400 can include a plurality of notch circuits, such as single high-frequency notch circuits 430*a*/430*b*/430*c*/430*d* that each correspond to the single notch circuit 230 and dual notch circuits 450*a*/450*b*/450*c* that each correspond to the dual notch circuit 330. The director element 400 includes an arrangement of notch circuits, from left to right, such as the single notch circuit 430*a*, a dual notch circuit 450*a*, another single notch circuit 430*b*, another dual notch circuit 450*b*, another single notch circuit 430*c*, another dual notch circuit 450*c*, and another single notch circuit 430*d*. In at least one embodiment, the length of the director element 400 is approximately (+=10%) 2.97 inches, an appropriate length for enhancing directivity of approximately (+=10%) 856 to 1300 MHz signals, as known to those skilled in the art of Quasi-Yagi antenna design.

The alternating pattern of the single notch circuits 430*a*/430*b*/430*c*/430*d* and the dual notch circuits 450*a*/450*b*/450*c* results in the director element 400 rejecting passage of 5.7 to 5.9 GHz energy, but only each pair of single and dual notch circuits reject passage of 2.4 to 2.5 GHz energy. In at least one embodiment, length of antenna segments between two neighboring single high frequency notch circuits 430*a*/430*b*/430*c*/430*d* can be between approximately (+−10%) 0.290 and approximately (+−10%) 0.370 inches, corresponding to approximately (+−10%) 60 degrees of antenna segment length at 5.9 GHz. Counting an initial feed length into the inductor elements prior to the notch rejection, this can result in approximately (+−10%) 65-70 degrees of antenna segment length at 5.9 GHz, to those skilled in the art of RF filter design. This short line length is insufficient to sustain a standing wave, and therefore is largely ignored (other than as a mild scattering obstacle) by frequencies in that range.

For a lower band, the dual notch circuits 450*a*/450*b*/450*c* are disposed approximately (+−10%) every 0.770 inches of printed circuit length, corresponding also to approximately (+−10%) 60 degrees of line length at 2.44 GHz midband. Counting the initial feed length as discussed above, this can result in approximately (+−10%) 65-70 degrees total between the dual notches 450*a*/450*b*/450*c*. As with the higher band, this line length is insufficient to sustain a standing wave between 2.4 and 2.5 GHz, so the entire construct of the director element 400 performs as a patterned mild scattering obstacle rather than a reflecting, radiating, or parasitic element.

Figure 5:
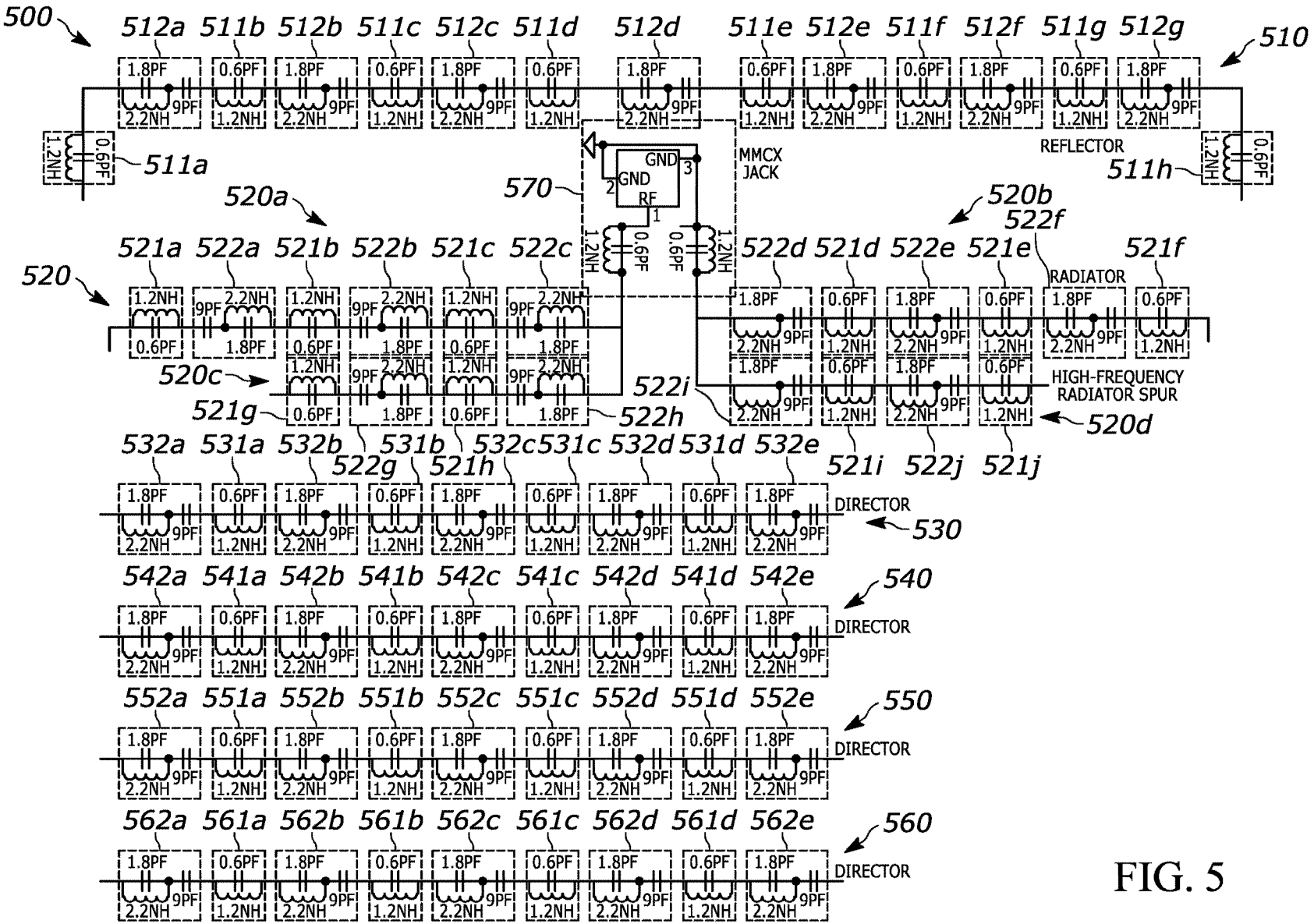
FIG. 5 illustrates another example antenna system, in accordance with at least one embodiment disclosed herein.

In at least one embodiment, the first antenna 110 is a Quasi-Yagi antenna that includes a radiator element 520, a reflector element 510, and at least two director elements, such as director elements 530/540/550/560. With reference to FIG. 5, an antenna system 500 is disclosed that includes the reflector element 510 disposed proximate to the radiator element 520 (e.g., a high-frequency radiator spur), the radiator element 520 being disposed proximate to the first director element 530, the first director element 530 being disposed proximate to the second director element 540, the second director element 540 being disposed proximate to the third director element 550, and the third director element 550 being disposed proximate to the fourth director element 560. As can be seen, the reflector element 510, the radiator element 520, and the first, second, third, and fourth director elements 530, 540, 550, and 560 all include the basic structure of the director element 400 shown in FIG. 4, that is alternating single notch circuits 230 and dual notch circuits 33, with antenna sections therebetween, as discussed above.

In at least one embodiment, the reflector element 510 includes eight (8) single notch circuits 511*a*/511*b*/511*c*/511*d*/511*e*/511*f*/511*g*/511*h* (e.g., each including 1.2 nH, 0.6 pF), with dual notch circuits 512*a*/512*b*/512*c*/512*d*/512*e*/512*f*/512*g* (e.g., each including 9 pF, 2.2 nH, 1.8 pF) disposed therebetween. In at least one embodiment, the radiator element 520 includes four (4) sub-elements 520*a*/520*b*/520*c*/520*d* all coupled to a wire jack 570, such as an MMCX jack. The radiating sub-elements 520*a* and 520*b* each include three (3) single notch circuits 521*a*/521*b*/521*c*/521*d*/521*e*/521*f* (e.g., each including 0.6 pF, 1.2 pF) alternating with three (3) dual notch circuits 522*a*/522*b*/522*c*/522*e*/522*f* (e.g., each including 9 pF, 2.2 nH, 1.8 pF) coupled thereto, respectively, as shown. The radiating sub-elements 520*c* and 520*d* each include two (2) single notch circuits 521*g*/521*h*/521*i*/521*j* (e.g., each including 0.6 pF, 1.2 pF) alternating with (2) dual notch circuits 522*g*/522*h*/522*i*/522*j* (e.g., each including 9 pF, 2.2 nH, 1.8 pF) coupled thereto, respectively, as shown.

In at least one embodiment, the antenna system 500 further includes the four (4) director elements 530/540/550/560. In at least one embodiment, the director elements 530/540/550/560 can all be disposed on a same side of the radiator element 520, as shown. In at least one embodiment, the director elements 530/540/550/560 can each be identically configured with a same number of alternating dual notch circuits, e.g., five (5) dual notch circuits (e.g., each including 9 pF, 2.2 nH, 1.8 pF), and single notch circuits, e.g., four (4) single notch circuits (e.g., each including 1.2 nH, 0.6 pF), with antenna sections therebetween, as discussed above. In at least one embodiment, other configurations for the director elements 530/540/550/560 are possible, without departing from the scope of the embodiment(s) disclosed. The director element 530 can include alternating dual notch circuits, e.g., five (5) dual notch circuits 532*a*/532*b*/532*c*/532*d*/532*e*, and single notch circuits, e.g., four (4) single notch circuits 531*a*/531*b*/531*c*/531*d*, with antenna sections therebetween, as discussed above. Likewise, director element 540 can include alternating dual notch circuits, e.g., five (5) dual notch circuits 542*a*/542*b*/542*c*/542*d*/542*e*, and single notch circuits, e.g., four (4) single notch circuits 541*a*/541*b*/541*c*/541*d*, with antenna sections therebetween, as discussed above. Likewise, director element 550 can include alternating dual notch circuits, e.g., five (5) dual notch circuits 552*a*/552*b*/552*c*/552*d*/552*e*, and single notch circuits, e.g., four (4) single notch circuits 551*a*/551*b*/551*c*/551*d*, with antenna sections therebetween, as discussed above. Likewise, director element 560 can include alternating dual notch circuits, e.g., five (5) dual notch circuits 562*a*/562*b*/562*c*/562*d*/562*e*, and single notch circuits, e.g., four (4) single notch circuits 561*a*/561*b*/561*c*/561*d*, with antenna sections therebetween, as discussed above.

Figure 6:
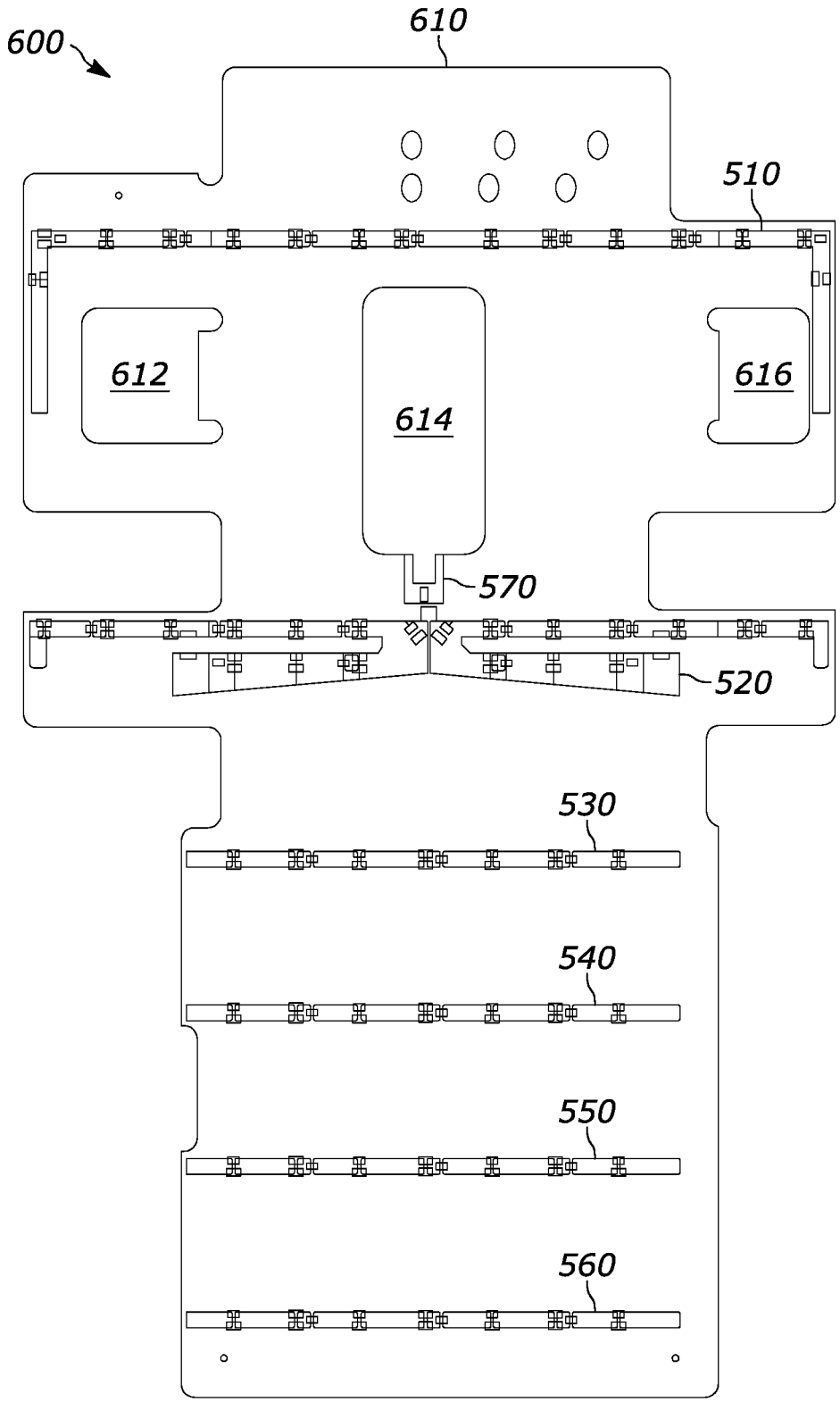
FIG. 6 illustrates another example antenna system including the antenna system shown in FIG. 5 printed on a PCB, in accordance with at least one embodiment disclosed herein.

FIG. 6 illustrates another antenna system 600 including the antenna system 500 of FIG. 5 printed on a Printed Circuit Board (PCB) 610. As can be seen in FIG. 6, the PCB 610 can be cut to follow the general area onto which the antenna system 400 is printed, creating at least one indent along a perimeter of the PCB 610, as shown. Such indent(s) minimizes a weight associated with the PCB 610, particularly helpful in implementation(s) where low weight is desired, such as for use with portable wireless devices. Also, the PCB 610 can include a via(s), such as vias 612/614/616 for mounting the antenna system 600 and providing easy access to the wire jack 570, as shown. Such via(s) 612/614/616 also minimizes a weight associated with the PCB 610.

In at least one embodiment, the reactive elements of the capacitors and the inductors of the single notch circuit 230 and the dual notch circuit 330 can be printed as part of a circuit trace 610, as shown. The values of capacitance (e.g., 0.6, 1.8, and 9 pF) discussed above and inductance (e.g., 1.2 and 2.2 nH) discussed above used for the 2.4 and 5.8 GHz examples are readily achieved as multilayered integrated passives in PCB fabrication processes. One skilled in the art will understand that such values are exemplary, with such values being selected for a particular implementation's frequency needs. Such PCB fabrication processes reduce manufacturing cost and substantially reduces assembly time.

Given a pad size area A, substrate thickness d, and dielectric constant $\varepsilon_r$, the return capacitive coupling C can be estimated using conventional parallel-plate capacitor equations by those familiar with basic electrical engineering principals.

$$C = \frac{\varepsilon_r \varepsilon_0 A}{d}$$

A calculation (not shown for the sake of brevity) estimates overlap pads made as integrated passives in a 4-layer board using foil laminated over e.g., pre-preg Isola FR-408, would be approximately (+=10%) 1 mm square yielding 0.6 pF in a more cost and size efficient manner than using a chip capacitor. The 9 pF capacitance, conversely, can be addressed as a chip capacitor.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A system, comprising:

a first antenna including an antenna section, the antenna section including a first antenna segment, a second antenna segment adjacent to the first antenna segment, and a notch circuit disposed within a notch between the first antenna segment and the second antenna segment, the notch circuit filtering a first frequency of a signal from passing from the first antenna segment to the second antenna segment while filtering a second frequency from the signal to pass from the first antenna segment to the second antenna segment; and a second antenna disposed proximate to the first antenna, the first antenna occupying a second near field region of the second antenna and the second antenna occupying a first near field region of the first antenna;

wherein the first antenna is a Quasi-Yagi Ultra High Frequency (UHF) antenna and the second antenna is a nested coaxial helical antenna.

2. The system according to claim 1, further comprising a reflector element that includes the antenna section.

3. The system according to claim 1, further comprising a radiator element that includes the antenna section.

4. The system according to claim 1, further comprising a director element that includes the antenna section.

5. The system according to claim 1, further comprising a reflector element, a radiator element, and a director element, each of the reflector element, the radiator element, and the director element including the antenna section.

6. The system according to claim 1, further comprising a Printed Circuit Board (PCB), the first antenna being printed onto the PCB.

7. A system comprising:

a first antenna including an antenna section, the antenna section including a first antenna segment, a second antenna segment adjacent to the first antenna segment, and a notch circuit disposed within a notch between the first antenna segment and the second antenna segment, the notch circuit filtering a first frequency of a signal from passing from the first antenna segment to the second antenna segment while filtering a second frequency from the signal to pass from the first antenna segment to the second antenna segment; and a second antenna disposed proximate to the first antenna, the first antenna occupying a second near field region of the second antenna and the second antenna occupying a first near field region of the first antenna;

wherein the notch circuit includes a capacitor in parallel with an inductor.

8. A system comprising:

a first antenna including an antenna section, the antenna section including a first antenna segment, a second antenna segment adjacent to the first antenna segment, and a notch circuit disposed within a notch between the first antenna segment and the second antenna segment, the notch circuit filtering a first frequency of a signal from passing from the first antenna segment to the second antenna segment while filtering a second frequency from the signal to pass from the first antenna segment to the second antenna segment; and a second antenna disposed proximate to the first antenna, the first antenna occupying a second near field region of the second antenna and the second antenna occupying a first near field region of the first antenna;

wherein the notch circuit is a first notch circuit and a second notch circuit, and the antenna section includes a third antenna section disposed between the first antenna section and the second antenna section, the first notch circuit including a first capacitor disposed between the first antenna segment and the third antenna segment and the second notch circuit is disposed between the third antenna segment and the second antenna segment, the second notch circuit including a second capacitor in parallel with an inductor.

9. A system comprising:

a first antenna including an antenna section, the antenna section including a first antenna segment, a second antenna segment adjacent to the first antenna segment, and a notch circuit disposed within a notch between the first antenna segment and the second antenna segment, the notch circuit filtering a first frequency of a signal from passing from the first antenna segment to the second antenna segment while filtering a second frequency from the signal to pass from the first antenna segment to the second antenna segment; and a second antenna disposed proximate to the first antenna, the first antenna occupying a second near field region of the second antenna and the second antenna occupying a first near field region of the first antenna;

wherein the antenna section is a first antenna section, the system further including a second antenna section coupled to the first antenna section, the first antenna section filtering a first frequency range from passing to the second antenna section and the second antenna section filtering a second frequency range from passing beyond the second antenna section, the first frequency range different than the second frequency range.

10. A system comprising:

a first antenna including an antenna section, the antenna section including a first antenna segment, a second antenna segment adjacent to the first antenna segment, and a notch circuit disposed within a notch between the first antenna segment and the second antenna segment, the notch circuit filtering a first frequency of a signal from passing from the first antenna segment to the second antenna segment while filtering a second frequency from the signal to pass from the first antenna segment to the second antenna segment;

a second antenna disposed proximate to the first antenna, the first antenna occupying a second near field region of the second antenna and the second antenna occupying a first near field region of the first antenna; and a ground plane that electrically couples together the first and second antennas;

wherein the second antenna includes a primary outer helix and an inner helix, the ground plane also coupling the primary outer helix and the inner helix together.

* * * * *